United States Patent [19]

Unsworth et al.

[11] 4,149,882

[45] Apr. 17, 1979

[54] MAGNESIUM ALLOYS

[75] Inventors: William Unsworth, Aspull; John F. King, Bury; Stephen L. Bradshaw, Bolton, all of England

[73] Assignee: Magnesium Elektron Limited, Swinton, England

[21] Appl. No.: 844,938

[22] Filed: Oct. 25, 1977

Related U.S. Application Data

[63] Continuation-in-part of Ser. No. 645,227, Dec. 29, 1975, abandoned.

[30] Foreign Application Priority Data

Dec. 30, 1974 [GB] United Kingdom ..... 56021/74

[51] Int. Cl.[2] ..... C22C 23/00

[52] U.S. Cl. ..... 75/168 J; 148/161

[58] Field of Search ..... 75/168 R, 168 J; 148/161, 32.5

[56] References Cited

U.S. PATENT DOCUMENTS

| | | | |
|---|---|---|---|
| 3,039,868 | 6/1962 | Payne et al. | 75/168 J |
| 3,419,385 | 12/1968 | Foerster et al. | 75/168 R |

*Primary Examiner*—M. J. Andrews
*Attorney, Agent, or Firm*—Karl W. Flocks

[57] ABSTRACT

Magnesium alloys having improved high-temperature properties, especially improved resistance to creep, contain from 1.25 to 3.0% silver, 0.5 to 2.5% of rare metals including at least 60% neodymium and from 2.5 to 7.0% thorium. Optimum properties are obtained by high-temperature solution treatment followed by aging at a lower temperature.

15 Claims, No Drawings

MAGNESIUM ALLOYS

This application is a continuation-in-part of application Ser. No. 645,227 filed Dec. 29, 1975 now abandoned.

This invention relates to magnesium alloys.

Magnesium alloys have a very low weight in comparison with alloys of other metals and accordingly find applications, particularly in the aerospace industry, where a low weight is important. Such alloys having advantageous mechanical properties, in particular a high proof stress, are described in Canadian Patent Specification No. 665,975, equivalent to U.S. Pat. No. 3,039,868 (Payne & Bailey).

Alloys within the scope of the latter specification have been used in aerospace components which are subject to relatively high stress, such as aircraft compressor housings, helicopter main gearboxes and undercarriage components. To obtain adequate mechanical properties it is necessary to subject these alloys to a two-stage heat treatment entailing solution treatment at a high temperature, followed by quenching and ageing at a lower temperature to improve the mechanical properties by precipitation hardening.

Mechanical properties thus obtained are well maintained during exposure to elevated temperatures up to 200° C. However, on exposure to temperatures above 200° C., mechanical properties deteriorate significantly, limiting the applications of such alloys in aircraft and other machinery, especially in engines and gearboxes operating in this temperature range.

In U.S. Pat. No. 3,419,385 (Foerster and Clark) there are disclosed magnesium alloys containing up to 10% of yttrium and up to 2% of silver, with zinc as an essential constituent. However Foerster and Clark prefer to use pure yttrium and teach that rare earth metals should not be present, and in any case should represent less than 1% of the alloy.

British Pat. No. 1,067,915 mentions that up to 10% of yttrium may be added to magnesium alloys containing zirconium to achieve further grain refining and reduce oxidation. It states that up to 3% of cerium may also be present but does not disclose any connection between the action of the cerium in the alloy and the yttrium.

There have now been found magnesium alloys having satisfactory tensile properties at room temperature which retain their advantageous properties, at temperatures of the order of 250° C. and show improved resistance to creep at these temperatures.

A combination of high strength and a high resistance to creep at elevated temperatures is highly desirable in components which are subjected to prolonged stress at a high temperature, as is the case with many aircraft components, but in hitherto known magnesium alloys high creep resistance is normally accompanied by only moderate strength, and vice-versa. The alloys of the present invention give tensile properties at least as good as those of the previously known "high strength" alloys and creep-resistance at least as good as those of known "creep-resistant" alloys.

It has further been found that the alloys of the present invention show very favourable casting properties, an important feature when complex shapes are to be cast.

According to one aspect of the invention, there is provided a magnesium-based alloy containing the following constituents by weight (other than iron and other impurities):

| | |
|---|---|
| Silver | 1.25–3.0% |
| Rare earth metals of which at least 60% is neodymium | 0.5–3.0% |
| Yttrium | 2.5–7% |
| Thorium | 0–1% |
| Zirconium | 0–1% |
| Zinc | 0–0.5% |
| Cadmium | 0–1.0% |
| Lithium | 0–6.0% |
| Calcium | 0–0.8% |
| Gallium | 0–2.0% |
| Indium | 0–2.0% |
| Thallium | 0–5.0% |
| Lead | 0–1.0% |
| Bismuth | 0–1.0% |
| Copper | 0–0.5% |
| Manganese | 0–2.0% |

It should be noted that yttrium is not itself considered as a rare earth metal. The maximum amount of Mn is limited by its mutual solubility with zirconium when the latter is present.

It has been found that the creep-resistance of the alloy, while excellent throughout the ranges mentioned above is particularly high when the yttrium content is from 3 to 5%. On the other hand, exceptionally high tensile properties are obtained at yttrium contents from 5 to 7%.

The rare earth metals may be 100% neodymium, but as this material is expensive in the pure state it is preferred to use a mixture of metals, sometimes known as didymium, which contains at least 60% by weight of neodymium with the remainder consisting substantially of the other rare earth metals such as praseodymium.

It is desirable for cerium and lanthanum to be absent or at least present in very small quantities and accordingly the content of lanthanum and cerium together in the rare earth metal mixture should not exceed 25% by weight. It has been found that the presence of cerium gives greatly inferior yield and ultimate tensile strengths at both low and high temperatures.

An increasing silver content increases the cost of the alloy but on the other hand reducing the silver content below 2% gives a reduction in yield strength. Alloys containing 2–3% silver are therefore preferred.

The yttrium may be added to the alloy as pure yttrium but it may be preferred to add it as an yttrium/-rare earth metal mixture containing at least 60%, preferably at least 65% by weight of yttrium.

In the provisional specification of British Patent Application 56021/74 there are disclosed improved magnesium alloys containing 0.5–2.1% of neodymium and 0.3–1.9% of thorium with the total amount of these two elements being from 1.5 to 2.4%. It has been found that, within the overall composition limits defined above, all or part of the thorium of said improved alloys may be replaced by a suitable amount of yttrium to give equally good or better tensile properties at elevated temperatures. The presence of yttrium has the further advantage that resistance to creep at elevated temperatures is improved.

It may be desirable for the alloy to contain up to 1% of zirconium as a grain refiner. It is then preferred that the zirconium content should be at least 0.4%. However, when the requirement for a high creep resistance is exceptionally critical it may be desirable to omit zirconium in order to obtain a larger grain size and hence improve the creep resistance. It has been found, surprisingly, that omission of the zirconium in this way still gives an alloy with very favourable tensile properties. It has been confirmed that, even given the addition of yttrium in the alloy, the grain size is considerably greater than that obtained in the presence of zirconium. It may be desirable to add manganese in which case the amounts of zirconium and manganese are limited by their mutual solubility. Part of the desirable minimum of zirconium may be replaced by manganese.

The remaining elements mentioned above (zinc, cadmium, lithium, calcium, gallium, indium, thallium, lead and bismuth) may be present in the above mentioned amounts if they do not interfere with the action of the other constituents.

Heat treatment is normally required to obtain the optimum mechanical properties for these alloys. This comprises a high-temperature solution treatment at a temperature from 450° C. to solidus of the alloy for a sufficient time to obtain solution, generally at least 2 hours, followed by quenching and ageing at a lower temperature such as from 100° to 350° C. for at least ½ hour, the ageing time increasing at lower temperatures. Typical heat treatment conditions are 8 hours at 520° C. followed by quenching and ageing at 200° C. for 16 to 22 hours.

Alternatively the solution heat treatment may be carried out in two stages, for example at 480° C. for 8 hours, followed by 520° C. for 4 hours and quenching and ageing at 250° C. for 8 hours.

The solidus of the alloy varies according to its exact composition and falls appreciably at yttrium contents above 6%. The temperature of solution treatment may then have to be lowered accordingly. However the solidus may be decreased by omission of zirconium, necessitating a lower temperature solution treatment.

Alloys within the scope of the present invention, heat-treated as described above, have been subjected to metallographic examination using Microscopic Probe analysis. The results obtained are summarized as follows:

(a) On heat treatment of the castings at a temperature from 450° C. to the solidus followed by quenching and ageing at from 100° C. to 350° C., the alloys containing from 0.5 to 3% rare earth metals and from 2.5% to 7% yttrium showed markedly superior mechanical properties to those which contained less than 2.5% of yttrium or less than 0.5% rare earth metals. This effect increased with increasing amounts of yttrium.

(b) Alloys containing less than 2.5% of yttrium but at least 2% silver and at least 0.5% rare earth metals contained, after heat-treatment, a precipitate probably having the formula $Mg_{12}(Nd_2Ag)$?

(c) Alloys containing above 2.5% of yttrium contained an additional precipitate containing magnesium, silver, neodymium and also yttrium, the amount of this precipitate increasing with an increasing content of yttrium. This precipitate is believed to be responsible for the improved mechanical properties obtained in the alloys containing at least 2.5% of yttrium.

Alloys according to the present invention will be described by way of illustration by the following Examples.

EXAMPLES

Alloys having the compositions given in the table below were prepared and cast to make test specimens by a conventional method.

The specimens were then solution heat-treated for 8 hours at 500° to 525° C., followed by quenching and ageing for 16 to 22 hours at 200° C.

The yield strength, ultimate tensile strength and elongation at fracture of the specimens were measured at ambient temperature and at 250° C. in accordance with British Standard 3688. The results are given in Table 1.

TABLE 1

| Analysis % | | | | | Tensile Properties ($N/mm^2$) at 20° C. | | | Tensile Properties ($N/mm^2$) at 250° C. | | |
|---|---|---|---|---|---|---|---|---|---|---|
| Ag | Rare Earth Metals | Y | Zr | Th | Yield | Ultimate Tensile Strength | Elongation % | Yield Yield | Ultimate Tensile Strength | Elongation % |
| 2.09 | 2.10 | 1.60 | 0.54 | — | 199 | 269 | 5 | 159 | 182 | 17 |
| 2.02 | 2.10 | 1.60 | 0.55 | — | 201 | 268 | 4 | 162 | 181 | 16 |
| 2.05 | 2.10 | 2.70 | 0.53 | — | 206 | 281 | 3 | 160 | 202 | 18 |
| 2.05 | 1.72 | 4.06 | 0.56 | — | 202 | 284 | 4 | 164 | 249 | 8 |
| 1.07 | 2.10 | 3.40 | 0.55 | — | 173 | 281 | 3 | 141 | 231 | 14 |
| 2.08 | 0.52 | 3.20 | 0.53 | — | 175 | 264 | 5 | 130 | 201 | 8 |
| 2.06 | 1.55 | 3.40 | 0.54 | 0.50 | 208 | 290 | 3 | 169 | 227 | 6 |
| 2.66 | 2.16 | — | 0.58 | — | 217 | 282 | 4 | 148 | 163 | 16 |
| 2.72 | 2.22 | — | 0.53 | — | 213 | 278 | 4 | 134 | 164 | 19 |
| 2.5 | 1.8 | — | 0.5 | — | 195 | 247 | 2 | 130 | 151 | 15 |
| 2.0 | 2.1 | 1.4 | 0.6 | — | 205 | 245 | 2 | 166 | 191 | 16 |
| 1.8 | 1.1 | 2.9 | 0.7 | — | 181 | 306 | 14 | 148 | 235 | 17 |
| 2.0 | 2.1 | 3.8 | 0.7 | — | 202 | 284 | 4 | 164 | 249 | 8 |
| 2.0 | 3.1 | 4.0 | 0.6 | — | 217 | 291 | 2 | 171 | 248 | 5 |
| 1.9 | 2.1 | 4.5 | 0.7 | — | 207 | 308 | 4 | 165 | 245 | 5 |
| 1.9 | 0.8 | 5.1 | 0.7 | — | 206 | 304 | 6 | 166 | 254 | 16 |
| 2.0 | 2.1 | 5.6 | 0.6 | — | 233 | 345 | 3 | 186 | 282 | 6 |
| 2.0 | 2.1 | 6.6 | 0.5 | — | 236 | 326 | 2 | 189 | 291 | 5 |
| 1.9 | 1.9 | 5 | 0.5 | — | 227 | 299 | 2 | 170 | 252 | 7 |
| 2.0 | 1.9 | 7 | 0.5 | — | 256 | 354 | 2 | 190 | 286 | 10 |

It will be noted from these results that the higher temperature properties of the alloys containing above 2.5% yttrium were considerably better than those of similar alloys containing less than 2.5% yttrium and that the alloys containing the higher amounts of yttrium (5–7%) showed much improved room temperature properties also.

The same procedure was followed with a magnesium alloy containing 2.09% Ag, 3.04% Y and 0.52% Zr but with 1.2% of cerium in place of neodymium. The yield strength, ultimate tensile strength and elongation at 250° C. were respectively 107 $N/mm^2$, 134 $N/mm^2$ and 1%;

these figures are much lower than those of the neodymium-containing alloys.

In order to estimate the creep behaviour of the alloys of the invention, alloys having the following composition and heat-treated as described above were tested at 250° C. for creep according to British Standard 3500 and the results are given in Table 2 below.

TABLE 2

| Ag | Rare Earths | Zr | Y | 0.2/100 Creep strain (Stress in N/mm$^2$) |
|---|---|---|---|---|
| 2.5% | 2.2% | 0.5% | — | 28 |
| 2% | 2.2% | 0.5% | 4% | 55 |
| 2% | 2.1% | 0.6% | 1.4% | 44 |
| 2% | 2.1% | 0.5% | 6.6% | 50 |
| 2% | 1.9% | 0.5% | 7% | 51 |
| 2% | 2.0% | — | 7% | 56 |
| 1.9% | 1.9% | 0.5% | 5% | 61 |
| 2% | 2.3% | 0.5% | 3.6% | 66 |

It will be noted from these results that the creep resistance of the alloys containing above 2.5% yttrium is much better than at lower yttrium levels. It has been found the creep resistance is also affected by the grain size of the alloy.

TABLE 3

| Analysis % | | | | Plate Number | | | | | | | | | | | |
|---|---|---|---|---|---|---|---|---|---|---|---|---|---|---|---|
| | Rare Earth | | | 1 | | 2 | | 3 | | 4 | | 5 | | 6 | |
| Ag | Metals | Y | Zr | AA | MR | AA | MR | AA | MR | AA | MR | AA | MR | AA | MR |
| 2.4 | 1.90 | — | 0.60 | 60 | 3 | 20 | 2 | 60 | 3 | 50 | 7 | 80 | 4 | 50 | 7 |
| 1.9 | 1.90 | 5 | 0.50 | 10 | 1 | 10 | 1 | 10 | 1 | 50 | 5 | 15 | 2 | 50 | 5 |
| 2.0 | 1.90 | 7 | 0.50 | 10 | 1 | 10 | 1 | 10 | 1 | 50 | 4 | 10 | 1 | 50 | 5 |
| | | | | Slit Gated Spitaler Box Casting | | | | | | Bottom Run Spitaler Box Casting | | | | | |

For example the alloy mentioned in the above Table which contained no zirconium as a grain refiner, and consequently had a grain size of 0.2 mm, gave a higher creep ($\sigma=56$) strength than the alloy of practically the same composition containing 0.5% zirconium (grain size was 0.05 mm, $\sigma=51$).

In order to test their castability, alloys according to the invention were cast into plates then the porosities of the plates were tested according to ASTM standard 2.3.2 (¼" plate-sponge). The results are shown in the following Table 3. A.A. is the total percentage area of the plates affected by porosity and M.R. is the maximum ASTM porosity rating of that area.

It will be seen that the presence of yttrium gives a notable reduction in the intensity of porosity and, for the slit-gated spitaler box casting the area affected by porosity is also much reduced.

We claim:

1. A magnesium-based alloy consisting essentially of the following constituents by weight (other than iron and other impurities):

| | |
|---|---|
| Silver | 1.25–3.0% |
| Rare earth metals of which at least 60% is neodymium | 0.5–3.0% |
| Yttrium | 2.5–7% |
| Thorium | 0–1% |
| Zirconium | 0–1% |
| Zinc | 0–0.5% |

-continued

| | |
|---|---|
| Cadmium | 0–1.0% |
| Lithium | 0–6.0% |
| Calcium | 0–0.8% |
| Gallium | 0–2.0% |
| Indium | 0–2.0% |
| Thallium | 0–5.0% |
| Lead | 0–1.0% |
| Bismuth | 0–1.0% |
| Copper | 0–0.5% |
| Manganese | 0–2.0% |

with the remainder, except for impurities, being magnesium.

2. An alloy according to claim 1, which contains from 3 to 5% by weight of yttrium.

3. An alloy according to claim 1, which contains from 5 to 7% by weight of yttrium.

4. An alloy according to claim 1, which contains at least 0.4% by weight of zirconium.

5. An alloy according to claim 1 which contains up to 0.2% manganese, the maximum and permissible amount of manganese being controlled by its mutual solubility with the zirconium if present.

6. An alloy according to claim 1, containing from 2 to 3% by weight of silver.

7. An alloy according to claim 1, in which the rare earths contain not more than 25% by weight of cerium and lanthanum taken together.

8. A cast article composed of an alloy according to claim 1 which has been solution heat treated at a temperature from 450° C. to the solidus of the alloy, followed by quenching and ageing at a temperature from 100° C. to 350° C.

9. An article according to claim 8, which has been solution treated for a period of at least two hours and aged for a period of at least half an hour.

10. An article according to claim 8, which has been solution heat treated at a temperature of about 520° C. for a period of 8 hours and aged at a temperature of about 200° C. for 16 to 22 hours.

11. An article according to claim 8, which has been solution heat treated firstly at 480° C. for 8 hours and secondly at 520° C. for 4 hours followed by ageing at a temperature of 250° C. for 8 hours.

12. An alloy according to claim 1 wherein the total quantity of said Thorium and said Rare Earth Metals of which at least 60% is Neodymium, is 1.52 to 0.4%.

13. An alloy according to claim 1 containing no Zirconium.

14. An alloy in accordance with claim 1 containing no Thorium.

15. An alloy in accordance with claim 1 containing at least 1.1% of said Rare Earth Metals.

* * * * *

UNITED STATES PATENT AND TRADEMARK OFFICE

CERTIFICATE OF CORRECTION

PATENT NO. : 4,149,882

DATED : April 17, 1979

INVENTOR(S) : William Unsworth, John F. King, Stephen L. Bradshaw

It is certified that error appears in the above—identified patent and that said Letters Patent is hereby corrected as shown below:

In the Abstract, line 5, delete "thorium" and insert therefore --yttrium--.

Signed and Sealed this

*Twenty-ninth* Day of *July 1980*

[SEAL]

*Attest:*

SIDNEY A. DIAMOND

*Attesting Officer*

*Commissioner of Patents and Trademarks*